US005896708A

United States Patent [19]

Doi et al.

[11] Patent Number: 5,896,708

[45] Date of Patent: Apr. 27, 1999

[54] MOVABLE SUPPORT FOR A RETRACTABLE ROOF

[75] Inventors: Yutaka Doi; Masashi Kusuyama, both of Hyogo-ken, Japan

[73] Assignee: Mitsubishi Heavy Industries, Ltd., Tokyo, Japan

[21] Appl. No.: 08/980,987

[22] Filed: Dec. 1, 1997

[30] Foreign Application Priority Data

Dec. 2, 1996 [JP] Japan ..... 8-321325

[51] Int. Cl.[6] ..... E04B 7/16

[52] U.S. Cl. ..... 52/66

[58] Field of Search ..... 52/66

[56] References Cited

U.S. PATENT DOCUMENTS 4,831,792 5/1989 Berger ..... 52/66

5,189,851 3/1993 Omika et al. ..... 52/66

FOREIGN PATENT DOCUMENTS 0151435 6/1991 Japan ..... 52/66

406272348 A 9/1994 Japan ..... 52/66

*Primary Examiner*—Carl D. Friedman

*Assistant Examiner*—Dennis L. Dorsey

*Attorney, Agent, or Firm*—Michael N. Meller

[57] ABSTRACT

Apparatus is provided for supporting a retractable roof. The support includes a support frame which supports the roof sections, and a follower wheel which moves along a rail formed in the retraction and expansion direction of the roof sections. The support frame has a base support having a spherical surface. Also included is a base capable of tolerating movement within a given range in the horizontal direction, substantially perpendicular to the rail and supported by the base support via a movement-limiting portion which limits the movement in the rail direction.

6 Claims, 5 Drawing Sheets

MOVABLE SUPPORT FOR A RETRACTABLE ROOF

The present invention relates to a movable support for a retractable roof. More particularly, the present invention relates to an apparatus which supports, retracts, and expands the retractable roof of a stadium or arena. It specifically relates to a support which can release stress due to thermal expansion and the like.

BACKGROUND OF THE INVENTION

FIGS. 3 and 4 show a structure in which a roof 1, a retractable roof of a stadium or arena comprises a plurality of roof sections 1*a* through 1*d* which are laid or telescoped over each other when they are retracted and which form a single unitary roof structure when expanded. Sliding roof sections 1*a* through 1*c* are supported at both ends on rails Ra through Rc formed on steps in the upper portion of the building. Sliding roof sections 1*a* through 1*c* are retracted by automating a movable support 50 or winching them with cables. It is evident that the roof is exposed to external stress from thermal expansion or thermal shrinkage due to the environmental temperature changes, causing displacement in the joint between rails Ra through Rc and movable support 50. As a result, the roof is exposed to external stresses from twisting, lifting, or tension forces, making a smooth drive movement of the roof sections difficult.

To lessen the influence from such various external stresses, the roof of conventional technology has a structure such as that shown in FIG. 5. In a front elevational view, support frame 56 is mounted with base 52, which supports sliding roof section 1*a* via a universal joint 55 connected by means of pins 53 and 54 arranged substantially parallel to a rail Ra and substantially perpendicular to the rail Ra. Support frame 56 also includes a drive wheel and follower wheel 57, which move along rail Ra. The support frame 56 also includes guide wheels 58, which move along side guide rails Rg.

In the movable support of FIG. 5, as is the case for a bogie car, the tolerance for absorbing the distortion due to the external stress is created by arranging pins 53 and 54 substantially parallel to rail Ra and substantially perpendicular to the rail Ra. Nevertheless, this level of tolerance is not sufficient to reduce the influence of external forces coming from different directions. This requires a larger tolerance for absorbing stress.

The apparatus incorporating the principles of the present invention resolves the problem and provides a movable support for the retractable roof which can transmit the movement of the movable support to the sliding roof sections with little tolerance. It also provides a movable support which is capable of reducing the influence from external forces coming from different directions and can tolerate a relatively larger distortion and displacement.

SUMMARY OF THE INVENTION

It is accordingly an object of the present invention to overcome the problems of prior art solutions.

In accordance with a preferred embodiment of the present invention, apparatus is provided for supporting a roof section of a retractable roof of a building. The apparatus includes a rail, fixedly mounted, and extending in a direction along which the roof is retracted and expanded. A support frame is provided having a wheel rotatably mounted thereon and cooperating with the rail for moving the support frame along the rail. A base support, having a spherical surface, is mounted on the support frame. Also included is a base mounted on the base support and adapted to have a roof section mounted thereon for movement between a retracted roof position and an expanded roof position.

In a further embodiment, the rail is mounted substantially horizontally and the base support has a movement-limiting portion. The base is capable of tolerating movement within a preselected range in the horizontal direction substantially perpendicular to the extended direction of the rail.

In another embodiment, the base is coupled to the base support by a coupling member which limits vertical movement of the base with respect to the base support.

In still a further embodiment, the movement-limiting portion includes a pair of lower racks mounted on the base support and having stoppers at both ends. The racks are fixed in the horizontal direction, substantially perpendicular to the rail. A lower limiting rail is provided between the lower racks. A pair of upper racks is included having stoppers on both ends and arranged opposite the lower racks, the upper racks being mounted at the bottom of the base. An upper limiting rail is provided between the upper racks. A plurality of pinions are included rotatably mounted on respective shafts and engaged with the lower and upper racks. The shafts have limiting grooves at the centers thereof. The grooves are engaged with the limiting rails.

BRIEF DESCRIPTION OF THE DRAWINGS

The above and other objects, features, and advantages of the present invention will become more apparent from the following detailed description taken with the accompanying drawings, in which.

DESCRIPTION OF THE PREFERRED EMBODIMENTS

Figure 1:
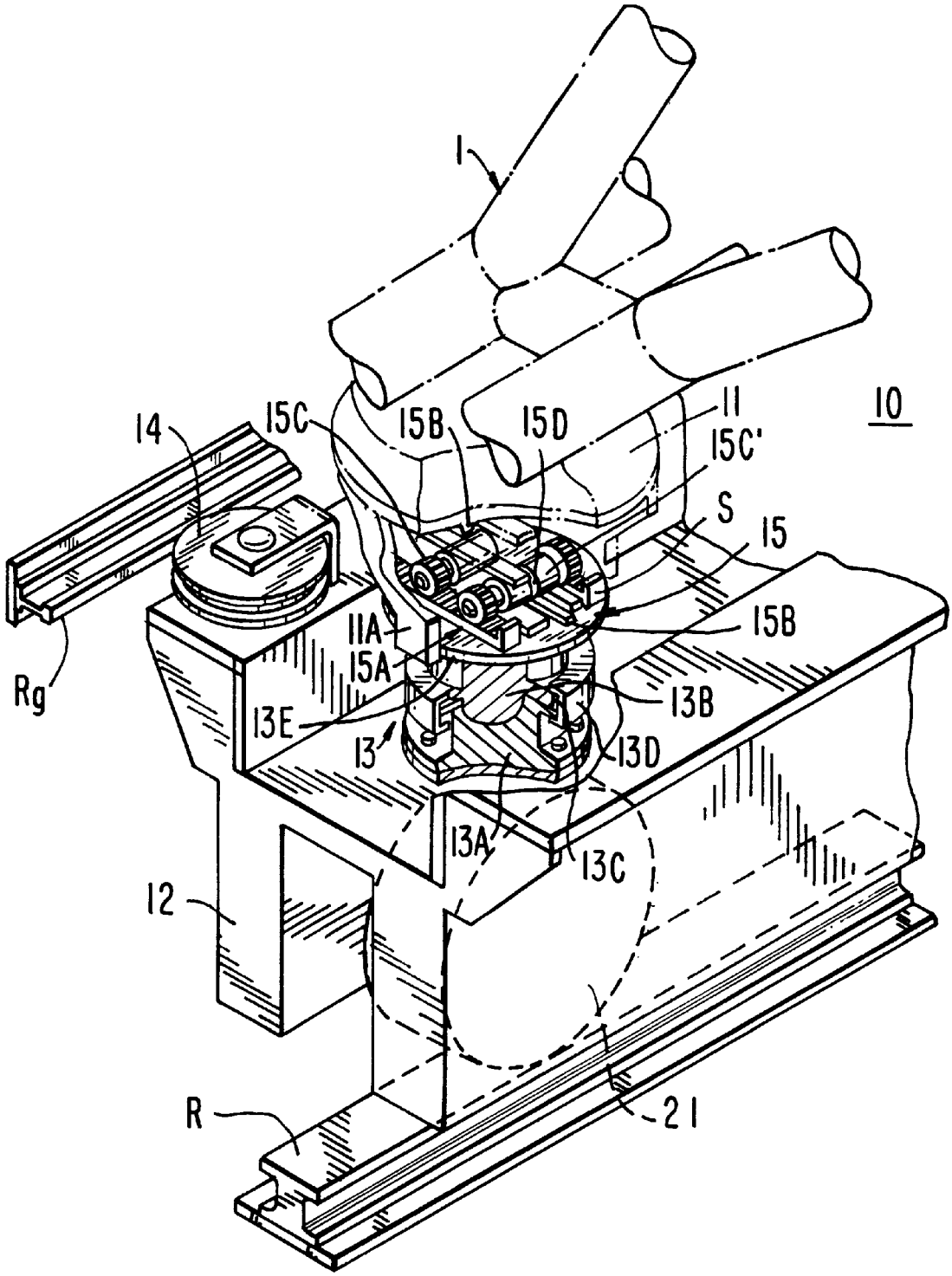
FIG. 1 is a perspective view, partially in section, of a preferred embodiment of the main support component of a retractable roof incorporating the principles of the present invention.
Figure 2:
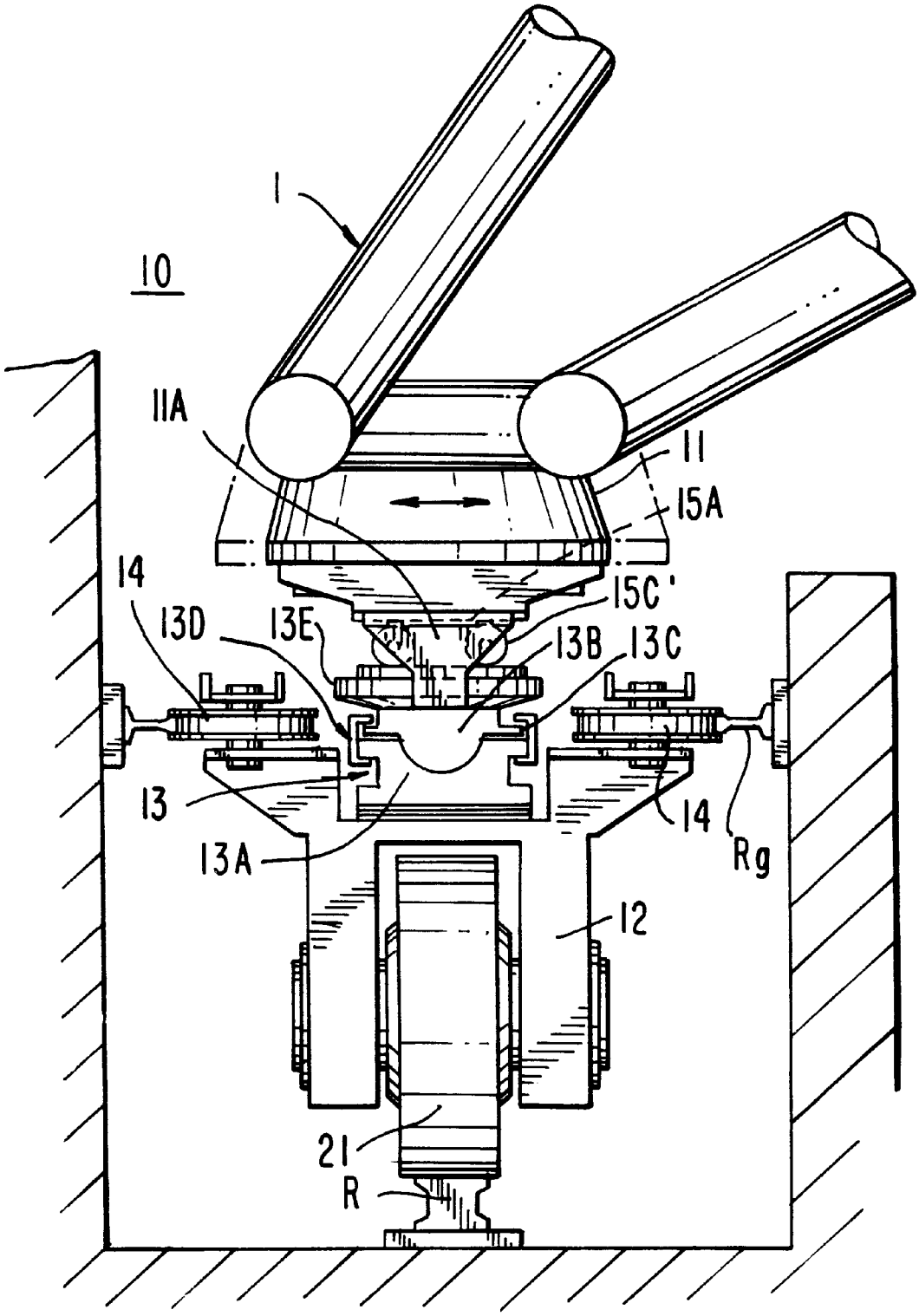
FIG. 2 is a front elevational view including a partial cross-section of the movable support.
Figure 3:
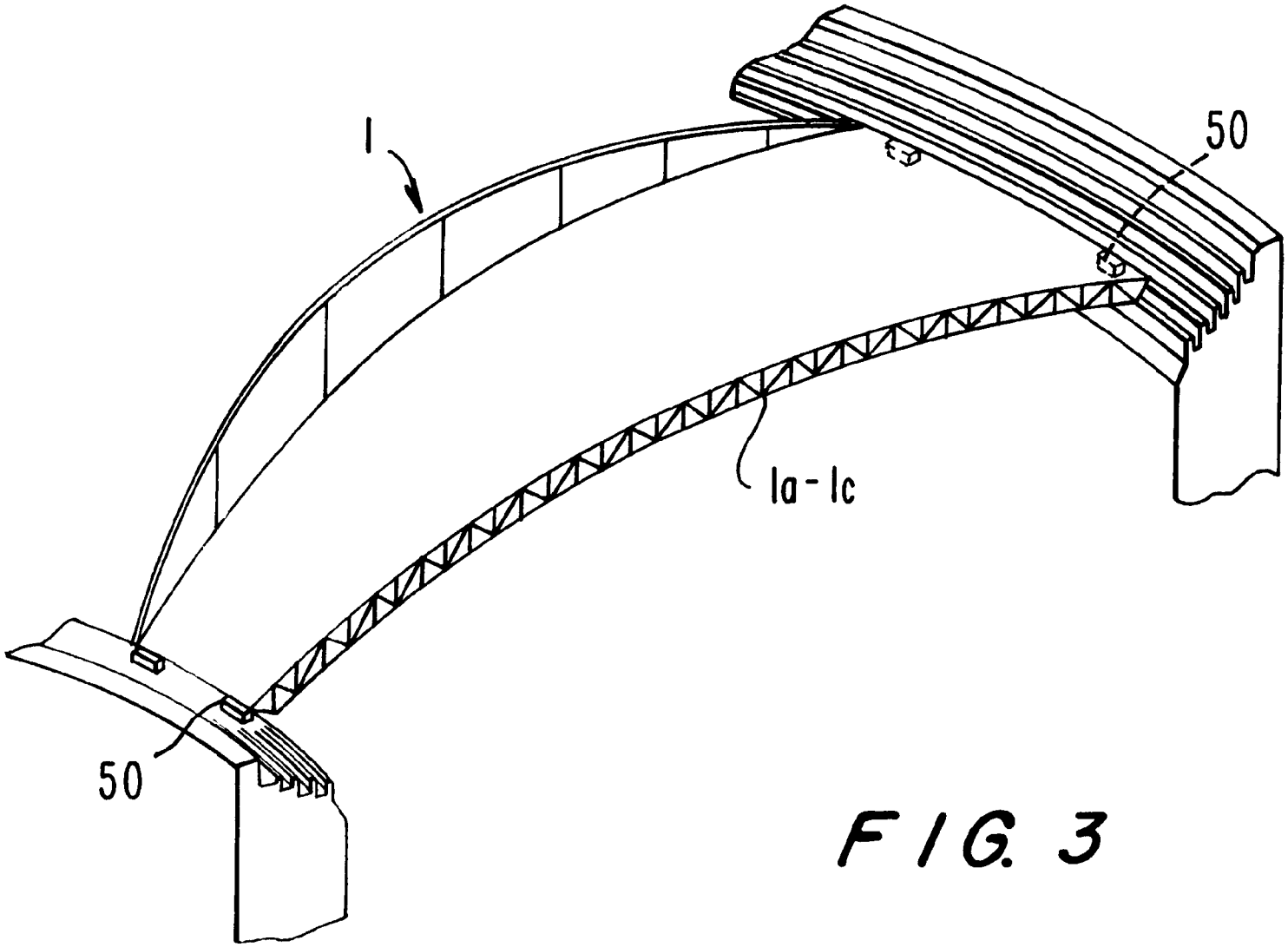
FIG. 3 is a perspective view showing a roof section of a retractable roof.
Figure 4:
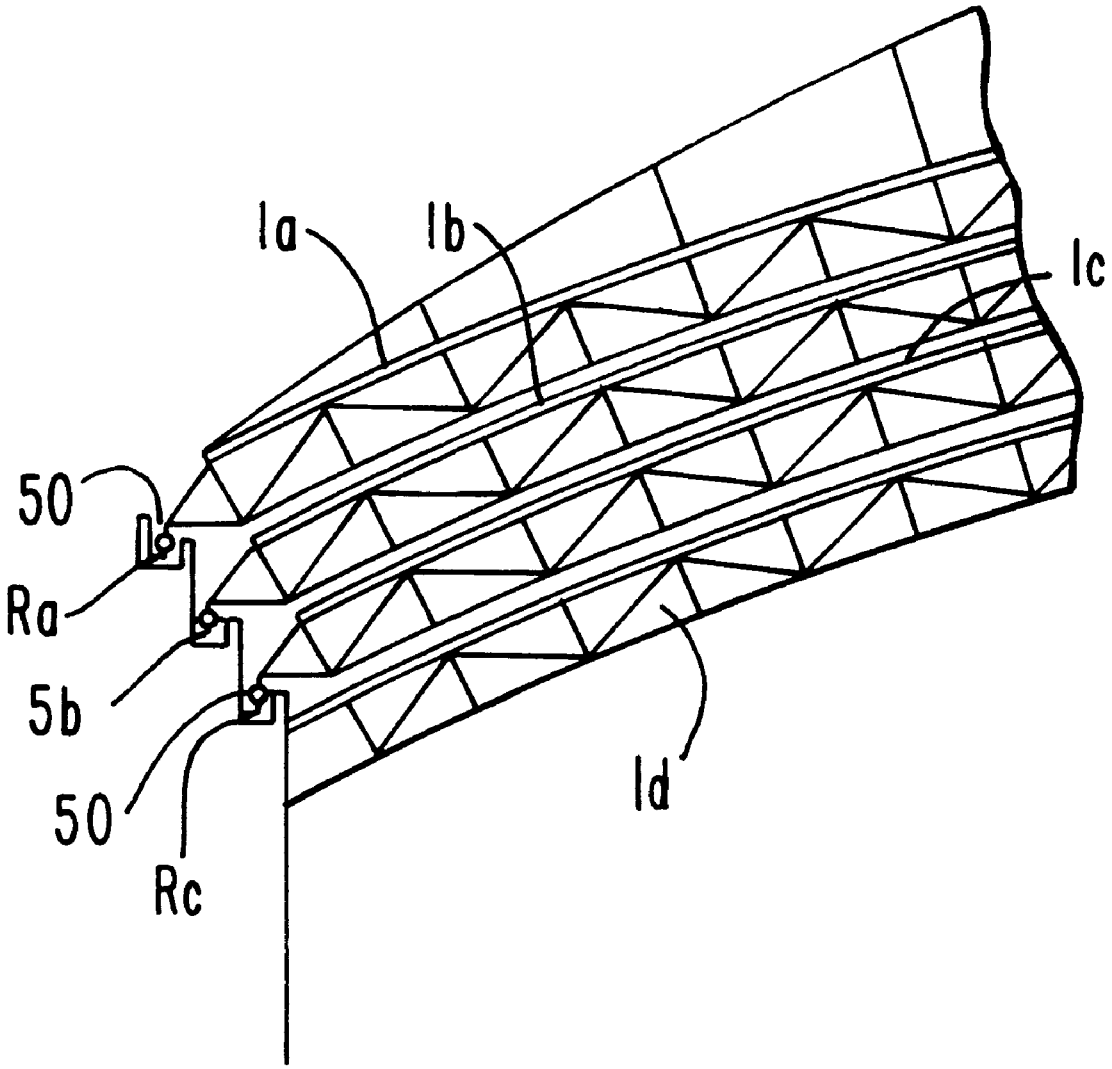
FIG. 4 is a plan view of telescoping roof sections laid over each other when they are in a retracted position.
Figure 5:
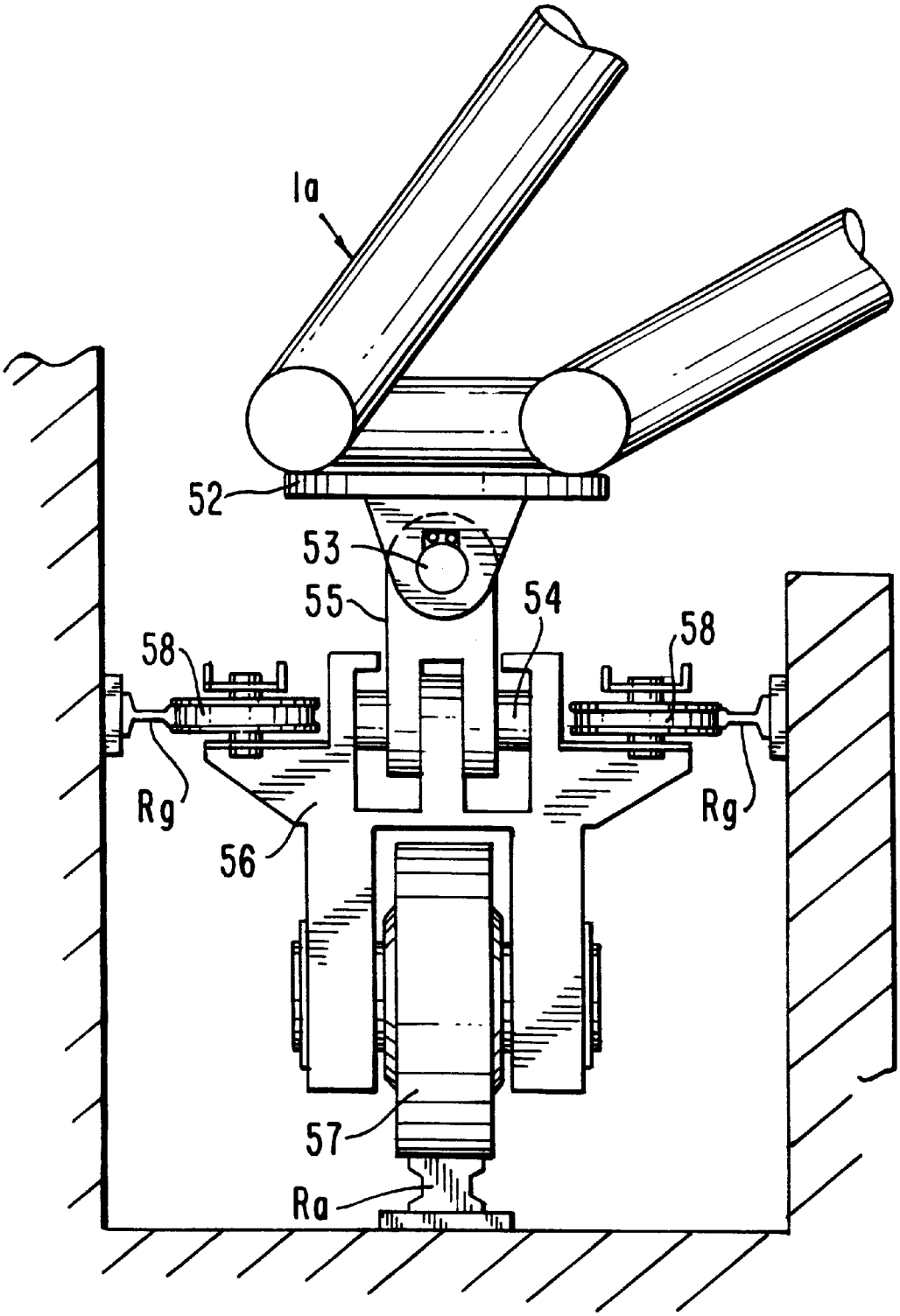
FIG. 5 PRIOR ART
FIG. 5 is a front elevational view of a movable support of a retractable roof of conventional technology.

Referring to the drawings, FIGS. 1 and 2 show a preferred embodiment of the present invention. A movable support 10 for the retractable roof includes a support frame 12. Frame 12 supports, via a base 11, a retractable roof section 1 of a stadium which can hold events such as baseball games. A rail R is provided and arranged in the direction in which the frame 1 retracts and expands. Follower wheels 21 move along the rail R, driven by drive wheels (not illustrated), as the roof is retracted and expanded.

A base support 13 is located at the center of the top of support frame 12 and has a spherical surface. Base 11 is supported by base support 13 via movement-limiting portion 15 which moves within a given tolerance in the horizontal direction, substantially perpendicular to rail R, but limits movement in the direction of rail R. Guide wheels 14 are rotatably mounted at both sides of support frame 12. The guide wheels 14 support loads in the horizontal direction, which direction is substantially perpendicular to rail R. The wheels 14 move along side guide rails Rg. This structure prevents the movable support 10 from falling off of rail R.

Base support 13 has a base body 13A having a spherical surface fixedly mounted on support frame 12. Base 13 also includes a support body 13B which is slidably and rotatably mounted on base body 13A and has a peripheral flange 13C. Flange 13C of support body 13B is loosely engaged inside a circular flange 13D, which surrounds support body 13B such that support body 13B is bound to base body 13A having a spherical surface with a limited movement in the vertical direction. A pair of engagement members 11A depending from the circumference of base 11 are engaged with a flange 13E above support body 13B such that the vertical movement is limited. In this way, even if a force is applied on base 11 in the upward direction in FIGS. 1 and 2, base 11 will not be pulled up with respect to support body 13B. Thus the movement of movable support 10 is transferred from support base 13 having a spherical surface to base 11 with little tolerance.

The movement-limiting portion 15 includes lower racks 15A, each having a pair of stoppers S on both ends, arranged horizontally, in parallel, and substantially perpendicular to rail R. Racks 15A are mounted on support body 13B of base support 13 and mesh with pinions 15C. Between lower racks 15A is arranged a lower limiting rail 15B. Upper racks 15A, which also have a pair of stoppers S on both ends, are arranged at the bottom of base 11 opposite lower racks 15A. An upper limiting rail 15B is arranged between the upper racks 15A. The pinions 15C, which are rotatably supported on shafts 15C', are engaged with and between the lower and upper racks 15A. Limiting grooves 15D are provided in the center of shaft 15C' of the pinions 15C and are engaged with limiting rails 15B.

The large weight of the roof section which is loaded onto base 11 is appropriately spread via pinions 15C and racks 15A onto base support 13, which has a spherical surface. The distortion of the roof section due to thermal expansion or shrinkage can be absorbed within the tolerance which is provided by pinions 15C on racks 15A at base 11 and base support 13. The movement of these pinions 15C is limited within the area between stoppers S at both ends of racks 15A, thus pinions 15C do not fall. The driving force of movable support 10 is transmitted from the side of the base support having a spherical surface to the base side via limiting rail 15B on base support 13 and limiting grooves 15D, formed in the center shaft portion of the pinions, which are engaged with rail 15B.

In the movable support with the above configuration, the movement-limiting portion limits the movement in the rail direction. The movement force applied to the support frame is transferred to the base support, which has a spherical surface, and the movement-limiting portion above the base support, to retract the roof sections, and the twisting or slanting of the base is absorbed by means of a universal joint installed on the base support.

Also, the movement-limiting portion tolerates the movement in the horizontal direction, which is substantially perpendicular to the rail, within a given range. It can absorb thermal expansion or thermal shrinkage in the horizontal direction, which is substantially perpendicular to the rail, which generates the largest external stress among all other external forces. Thus, the movement-limiting portion can ensure the smooth movement of the movable support. The external force in the rail direction can be absorbed by sliding or spinning of the driving wheel and/or the follower wheel.

In addition to the above-described preferred embodiment, the movement-limiting portion 15 can include a pair of racks 15A arranged in parallel on both ends of base support 13 in the horizontal direction, substantially perpendicular to rail R; a limiting rail 15B between racks 15A; pinions 15C, which are engaged with racks 15A and are rotatably supported by limiting rail 15B on the bottom of the projection of base 11; and limiting grooves engaged with limiting rail 15B under the bottom of the base portion.

Stoppers S, which stop the movement of pinions 15C to limit the amount of movement, may be formed on both ends of racks 15A or may be formed on base 11 if the projection at the bottom of base 11 is provided with a large bearing capacity for accommodating the pinion shaft. The load can be dispersed as well as with the above preferred embodiment, providing an equivalent to this embodiment. A simpler structure can be obtained as well. Also, the force of movable support 10 can be transmitted as well as in the preferred embodiment. The distortion due to thermal expansion or shrinkage of roof section 1 can also be tolerated as well as in the preferred embodiment.

This structure can appropriately spread the external force via the pinion and the racks onto the base support, which has a spherical surface. The distortion of the frame due to thermal expansion or shrinkage can be absorbed within the tolerance provided by the pinion movement on the racks on the base support, which has a spherical surface. The movement of this pinion is limited within the area between the stoppers at both ends of the racks, thus the pinion does not come off. The driving force of the movable support is transmitted from the side of the base support which has a spherical surface, to the base side via the limiting rails on the base and the base support engaged with limiting grooves on the center shaft portion of the pinions.

If the weight of the roof sections loaded onto the base is transferred to the base support, which has a spherical surface, via a pinion and racks, the distortion of the roof sections due to thermal expansion or shrinkage and the like can be absorbed by the movement of the pinion on the racks on the base support, which has a spherical surface. On the other hand, the driving force of the movable support can be transferred to the base via a limiting rail on the base support, which has a spherical surface, and the limiting groove under the base which is engaged with the rail.

As described above, a movable support of the retractable roof incorporating the principles of the present invention can absorb the twisting or slanting of a roof section by limiting the movement in the rail direction by means of the movement-limiting portion. The force added to the base for limiting the movement is transmitted to the base via the base support having a spherical surface and the movement-limiting portion above the base support during retraction. The movement-limiting portion can tolerate a movement in the horizontal direction, substantially perpendicular to the rail R, within a given range. The thermal expansion or thermal shrinkage in the horizontal direction, substantially perpendicular to the rail, which generates the largest external stress among all various external stresses can be absorbed, thus smoothing the movement of the movable support. The external stress in the rail direction can be absorbed by means of sliding or turning of the driving wheel or follower wheel.

Various modifications will become possible for those skilled in the art after receiving the teachings of the present disclosure without departing from the scope thereof.

What is claimed is:

1. Apparatus for supporting a roof section of a retractable roof of a building, comprising in combination:

a rail, fixedly mounted, and extending in a direction along which said roof is retracted and expanded;

a support frame having a wheel rotatably mounted thereon and cooperating with said rail for moving said support frame along said rail;

a base support, having a spherical surface mounted on said support frame; and a base mounted on said base support and adapted to have a roof section mounted thereon for movement between a retracted roof position and an expanded roof position.

2. Apparatus, for supporting a roof section of a retractable roof of a building, comprising in combination:

a rail, fixedly mounted, and extending in a direction along which said roof is retracted and expanded;

a support frame having a wheel rotatably mounted thereon and cooperating with said rail for moving said support frame along said rail;

a base support, having a spherical surface, mounted on said support frame; and a base mounted on said base support and adapted to have a roof section mounted thereon for movement between a retracted roof position and an expanded roof position, wherein said rail is mounted substantially horizontally and said base support has a movement-limiting portion whereby said base is capable of tolerating movement within a preselected range in the horizontal direction substantially perpendicular to said extended direction of said rail.

3. Apparatus, as claimed in claim 2, wherein said base is coupled to said base support by a coupling member which limits vertical movement of said base with respect to said base support.

4. A Apparatus, as claimed in claim 3, wherein said coupling member has a peripheral portion to which said base is coupled.

5. Apparatus, as claimed in claim 2, wherein said movement-limiting portion includes:

a pair of lower racks mounted on said base support and having stoppers at both ends, said racks being fixed in the horizontal direction, substantially perpendicular to said rail;

a lower limiting rail between said lower racks;

a pair of upper racks having stoppers on both ends and arranged opposite said lower racks, said upper racks being mounted at the bottom of said base;

an upper limiting rail between said upper racks;

a plurality of pinions rotatably mounted on respective shafts and engaged with said lower and upper racks, said shafts having limiting grooves at the centers thereof, said grooves being engaged with said limiting rails.

6. Apparatus, as claimed in claim 2, wherein said movement-limiting portion includes:

a pair of racks arranged in parallel on both ends of said base support in the horizontal direction, substantially perpendicular to said rail;

a limiting rail arranged on said base, between said racks;

a plurality of pinions, respectively engaged with said racks and rotatably supported by said limiting rail on said base; and a limiting groove engaged with said limiting rail.

* * * * *